United States Patent [19]

Cerro et al.

[11] Patent Number: 5,038,147

[45] Date of Patent: Aug. 6, 1991

[54] ELECTRONICALLY SCANNED ANTENNA

[75] Inventors: Albert Cerro, Toulouse; Michel Coustere, Saint Germain En Laye; Benoît Hanin, Sainte Foy-D'Aigrefeuille; Régis Lenormand, Toulouse; Jean-Philippe Marre, Muret, all of France

[73] Assignee: Alcatel Espace, Courbevoie, France

[21] Appl. No.: 431,106

[22] Filed: Nov. 3, 1989

[30] Foreign Application Priority Data

Nov. 3, 1988 [FR] France ..... 88 14330

[51] Int. Cl.[5] ..... H01Q 3/22

[52] U.S. Cl. ..... 342/368

[58] Field of Search ..... 342/368, 374, 371, 383; 343/777, 754, 756; 333/109

[56] References Cited

U.S. PATENT DOCUMENTS

| | | | |
|---|---|---|---|
| 3,438,029 | 4/1969 | Fuchser et al. | 333/121 |
| 3,500,427 | 3/1970 | Landesman et al. | 342/368 |
| 3,737,899 | 6/1973 | Georgopoulos | 342/157 |
| 4,090,199 | 5/1978 | Archer | 342/372 |
| 4,228,436 | 10/1980 | DuFort | 342/371 |
| 4,257,050 | 3/1981 | Ploussios | 342/372 |
| 4,544,927 | 10/1985 | Kurth et al. | 342/373 |
| 4,583,061 | 4/1986 | O'Shea | 333/116 |

FOREIGN PATENT DOCUMENTS 203403 9/1987 Japan .

OTHER PUBLICATIONS

Patent Abstracts of Japan, vol. 12, No. 60(E-584) (2907), Feb. 23, 1988; & JP-A-62-203-403 (Kokusai Denshin Denwa), 8.9.1987.

*Primary Examiner*—Gregory C. Issing

*Attorney, Agent, or Firm*—Sughrue, Mion, Zinn, Macpeak & Seas

[57] ABSTRACT

An electronically scanned antenna comprising an array (11) of elementary sources, an energy-focusing reflector (10), and feed and control electronics, with the array (11) being situated in the focal zone of the reflector, and in which elementary sources that are not used simultaneously are grouped together in classes (Ci) in which only one source can be active at a time, with all of the sources in each class (Ci) being interconnected by a passive combiner (40) for that class. The invention is applicable in particular to space telecommunications.

4 Claims, 9 Drawing Sheets

ELECTRONICALLY SCANNED ANTENNA

BACKGROUND OF THE INVENTION

A work entitled "Space Telecommunications" in the Scientific and Technical Telecommunications Collection published by Masson, 1982, and in particular in Vol. I thereof at pages 92 to 95 and pages 259 to 261, describes firstly the grouping together of a plurality of antennas fed simultaneously by a single transmitter with interposed phase shifters and power dividers, such that the radiation characteristics of the group depend both on the radiation pattern of each antenna and on the distribution of power in phase and in amplitude. This property is made use of to obtain a radiation pattern that could not be obtained using a single radiating source. In addition, if the characteristics of the phase shifters and of the power dividers are changed by electronic means, it is possible to obtain a quasi-instantaneous change in the radiation pattern. The simplest form of grouping for radiation sources is an array in which all of the sources are identical and differ from one another by translation in some direction. In particular, it is possible to have arrays which are rectilinear or planar.

The above-mentioned document also describes the use of antennas having reflectors for generating multiple beams, having the advantage of low weight and the possibility of obtaining large radiating areas by using deployable structures. Antennas of this type are generally used when it is desired to generate numerous narrow beams. In general, the system for illuminating the reflector is off-center relative to the reflector so as to avoid masking any of its radiating aperture. Masking in the aperture gives rise to higher levels of secondary lobes which is to be avoided at all costs in this type of application. The main reflector may be a paraboloid, for example. The multiple beams are obtained by placing a set of illuminating sources in the vicinity of its focus, with each source corresponding to one of the beams. Since they cannot all be placed exactly at the focus, the illumination is not geometrically perfect and phase aberrations result which degrade radiation performance somewhat. The radiation pattern is deformed, with reduced gain relative to the value that can be obtained from the focus, and with parasitic secondary lobes. The degradation increases with increasing distance from the focus and with increasing curvature of the reflector. It is therefore necessary to make reflectors which are as "flat" as possible, i.e. having a high value for the ratio of focal length to aperture diameter. This gives rise to structures which are large in size and which present problems of accuracy and mechanical strength. In addition, mutual parasitic coupling may exist between the various sources, thereby giving rise to additional secondary lobes.

In space, applications that require the radiated wave to be electronically deflected over a wide field of view give rise to angular deviations of several beam widths. It is consequently essential to be able to control the shape of the antenna radiation pattern accurately. The configuration of these large antennas must also take account of several system aspects:

small volume on board the satellite, making it necessary to use the same antenna for transmitting and receiving simultaneously;

compatibility with the mechanical mounting facility on the platform, and on the launcher both before and during operation;

good temperature control; and the possibility of having numerous missions and users.

The object of the invention is to solve these various problems.

SUMMARY OF THE INVENTION

To this end, the present invention provides an electronically scanned antenna comprising an array of elementary sources, an energy-focusing reflector, and feed and control electronics, with the array being situated in the focal zone of the reflector, and in which elementary sources that are not used simultaneously are grouped together in classes in which only one source can be active at a time, with all of the sources of each class being interconnected by a passive combiner for that class.

In accordance with the invention, the combiner may comprise a set of hybrid junctions whose outputs are combined in pairs to obtain the useful output signal(s).

Advantageously, the feed electronics include a switching device.

The solution proposed is of the electronically scanned type. It is constituted by an array synthesizing the electromagnetic field in the focal zone of a reflector.

Compared with mechanical solutions, the invention presents the advantage of not requiring the source or the reflector to move. It makes it possible to use short focal lengths (i.e. compact antennas). It can provide a plurality of links simultaneously.

Its advantages compared with a direct radiation array are as follows:

antenna performance is not directly related to the total size of the array; and it is not necessarily disposed on the ground-facing side of the satellite.

Compared with a solution using an imaging array and a single reflector, the solution proposed has the following advantages:

the overall size of the array is small; and antenna efficiency is improved.

Finally, if the proposed solution is compared with a solution comprising an imaging array and two reflectors, then the compactness of the antenna of the present invention is clearly seen.

BRIEF DESCRIPTION OF THE DRAWINGS

Embodiments of the invention are described by way of example with reference to the accompanying drawings, in which.

DETAILED DESCRIPTION

Figure 1:
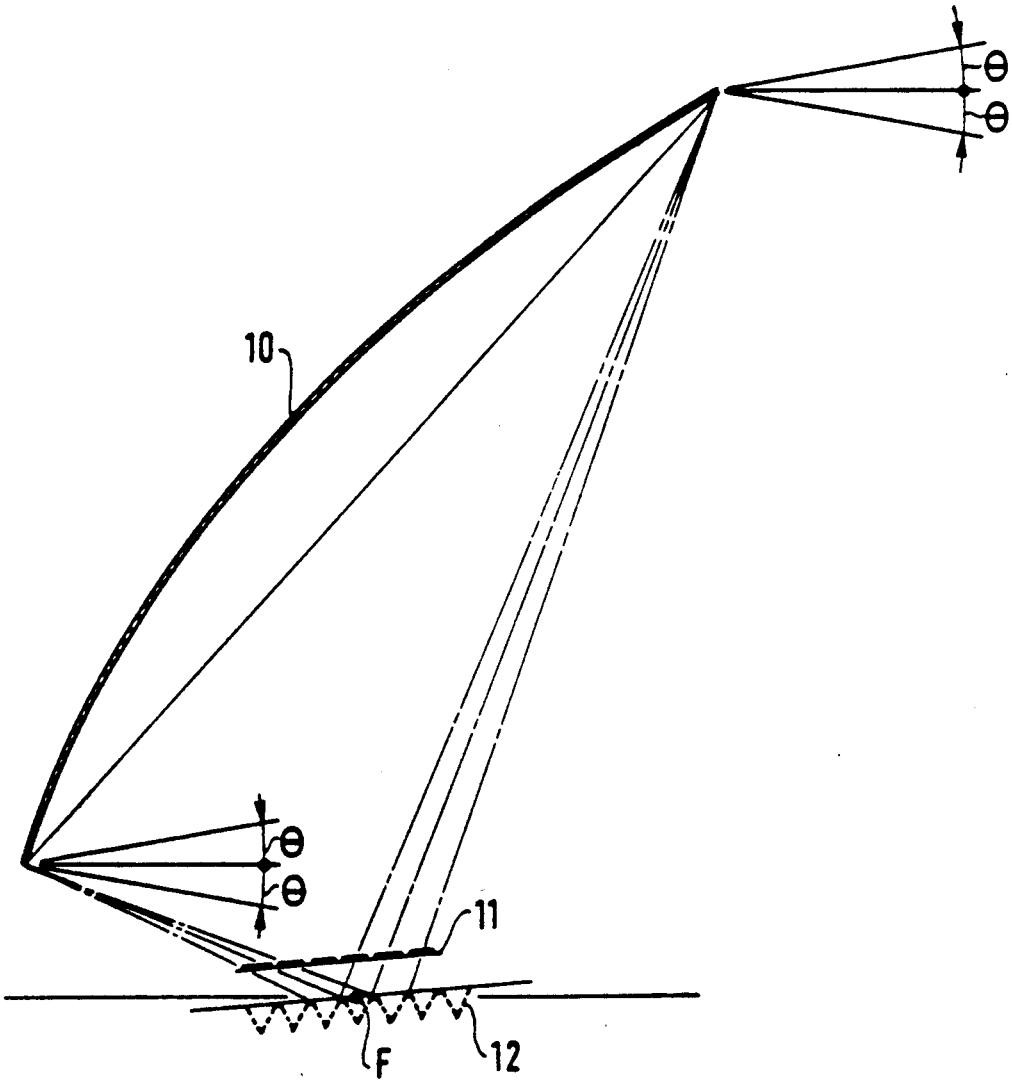
FIG. 1 is a diagram of a scanned antenna in accordance with the invention.

The antenna of the invention shown in FIG. 1 comprises an eccentric parabolic reflector 10 fed from a plane array 11 of sources situated in the vicinity of the focus F of the reflector, with array 12 representing the array of virtual sources corresponding to said array 11.

Figure 2:
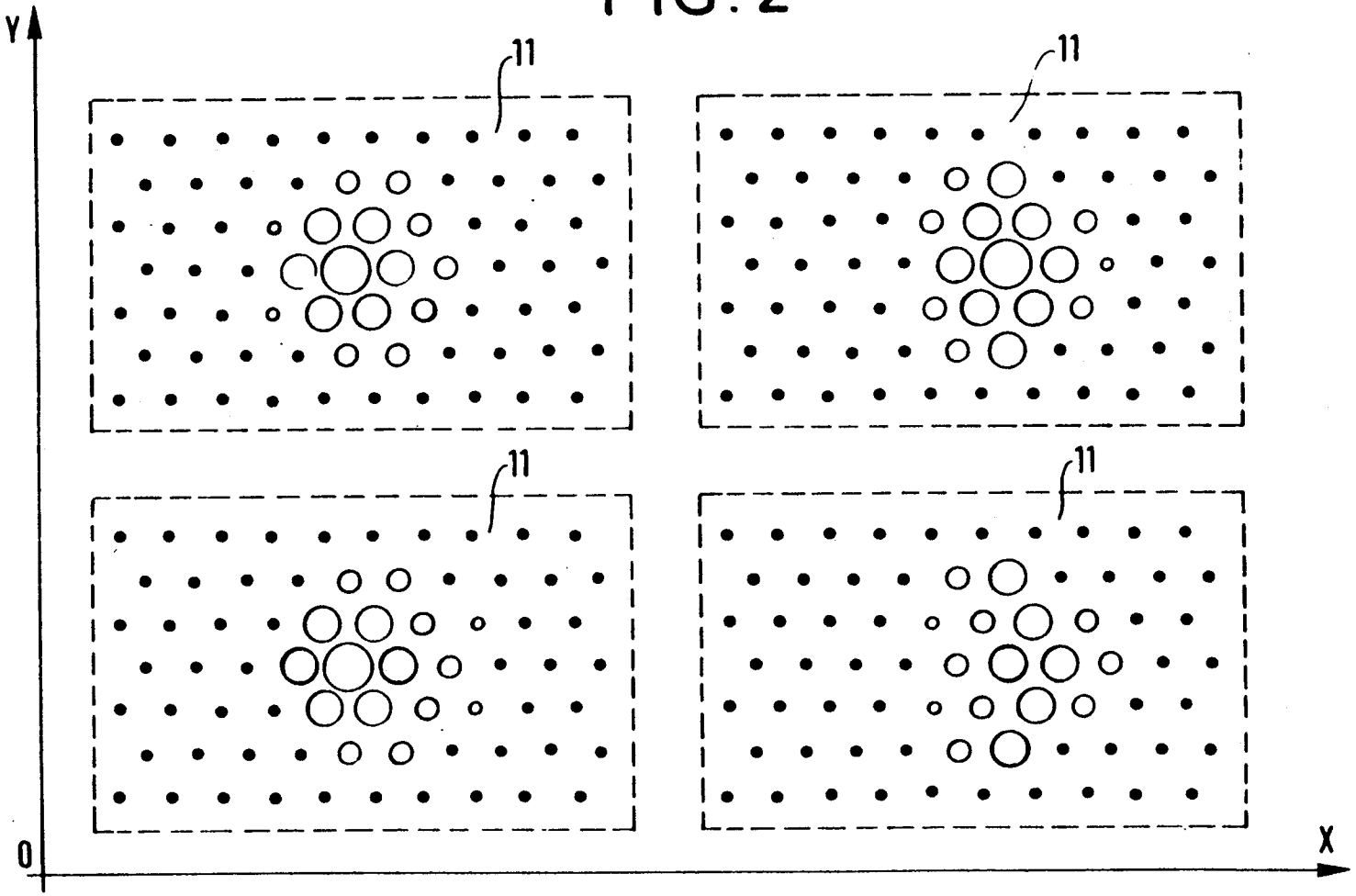
FIG. 2 shows how the antenna of the invention operates.

FIG. 2 shows an example of several amplitude distributions over the array 11 of sources during displacements along two directions OX and OY.

The diameters of the disks marked in FIG. 2 represent the amplitude of the signal received by the corresponding array source.

Sensing efficiency for these various different energy distributions when the sensor obeys a fixed distribution law cannot be optimum. The same applies to phase distribution.

Thus, if a source would be displaced relative to the focus of the reflector, the efficiency of the antenna is degraded.

In the antenna of the invention, both the amplitude and the phase of each elementary source are modified. This makes it possible to obtain optimum synthesis for each elementary source as though it were genuinely located at the focus F of the reflector.

Operating in this way makes it possible to provide an antenna whose gain does not depend on the direction in which it is pointed, while nevertheless keeping stationary both the reflector 10 and the array 11 of elementary sources.

By using the array 11 of sources, components are sensed locally corresponding to the genuine distribution. After filtering and amplification, these components are subjected to phase terms (by variable phase shifters) in order to cancel their phase differences, and they are added in an optimum manner by a summing circuit constituted by variable attenuators and hybrid couplers.

The displacement of the amplitude maximum in the field is a function both of the scan angle 0 and of the distance between the center of the reflector and the center of the array.

The size of the array is deduced from the maximum excursion and from the amplitude distribution. Because of aberrations, this distribution varies as a function of $\theta$.

Such a realization makes it possible to synthesize a field distribution which matches the electromagnetic field distribution in the region of the focus F of the reflector 10 as closely as possible. More precisely, when the antenna receives signals, this implies an optimization of the relative phase and amplitude coefficients applied to each of the elementary sources in the array in order to receive maximum power from a particular direction.

The relative phase and amplitude coefficients that need to be applied to the elements of the array are calculated by the technique well known to the person skilled in the art of matching by conjugate complexes. In order to transfer maximum power between each elementary source of the array and the surrounding field distribution, the overall field distribution across the array aperture must be the conjugate of the field distribution in the region of the focus of the reflector.

Controlling the amplitude and the phase of the elementary sources in this way presents numerous advantages, since in theory any arbitrary field distribution can be synthesized (depending on the spacing between the elementary sources). It is possible to relax the usual restriction to a large value for the ratio F/D, where F is the focal length of the reflector and D is its diameter (in order to reduce losses due to pointing error), thereby making it possible to optimize the position of the array. These characteristics have a considerable impact on the overall shape of the antenna subsystem. Thus, for example, the array may be mounted directly on a face of the satellite platform in order to facilitate temperature control. In addition, a low value for the ratio F/D can be used so as to make it possible to place the reflector close to the platform without giving rise to significant aiming error losses.

Figure 3:
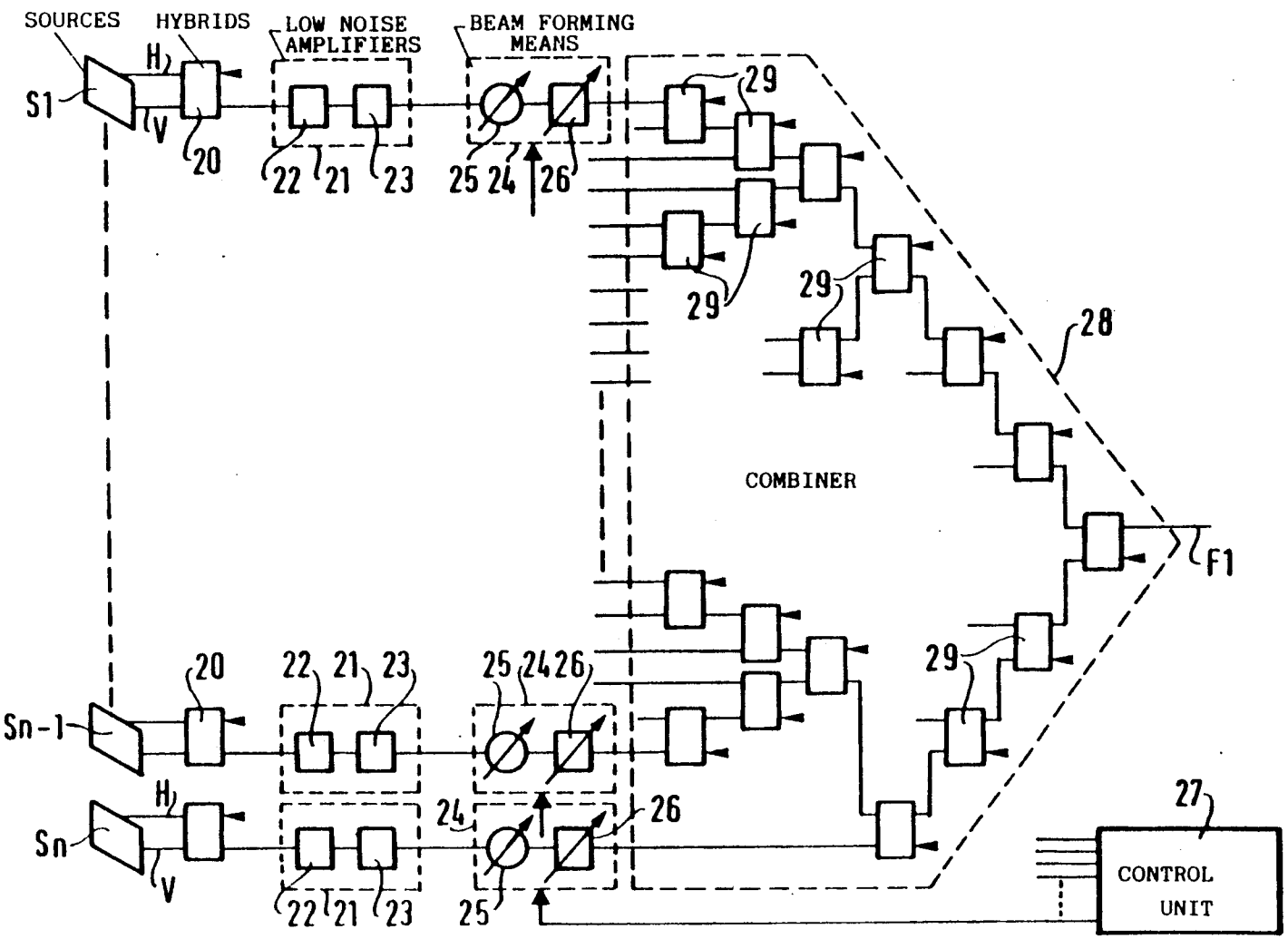
FIG. 3 shows a first embodiment of feed and control electronics for the antenna of the invention.

FIG. 3 shows a first embodiment of the electronics for implementing an antenna of the invention, for the case where only one beam is received.

At the outlet from each elementary source Sj there is a horizontal polarization first outlet H and a vertical polarization second outlet V, both of which are connected to a hybrid coupler 20 in which circular polarization is obtained constituting the sum of the horizontal and vertical polarizations with one of the signals being phase shifted relative to the other through 90° in time.

The respective signals obtained at the outlets from the hybrid couplers 20 are input to respective low noise amplifier circuits 21, each constituted, for example, by a filter 22 and an amplifier per se 23, followed by a beam-forming circuit 24 constituted by an adjustable phase shifter 25 and an adjustable attenuator 26 respectively controlled by a control unit 27. The antenna signals output from the beam-forming circuits are applied to a combiner 28 constituted by a set of microwave couplers 29, e.g. hybrid junctions whose outputs are combined in pairs until a useful output signal F1 is obtained corresponding to the beam under consideration.

Figure 4:
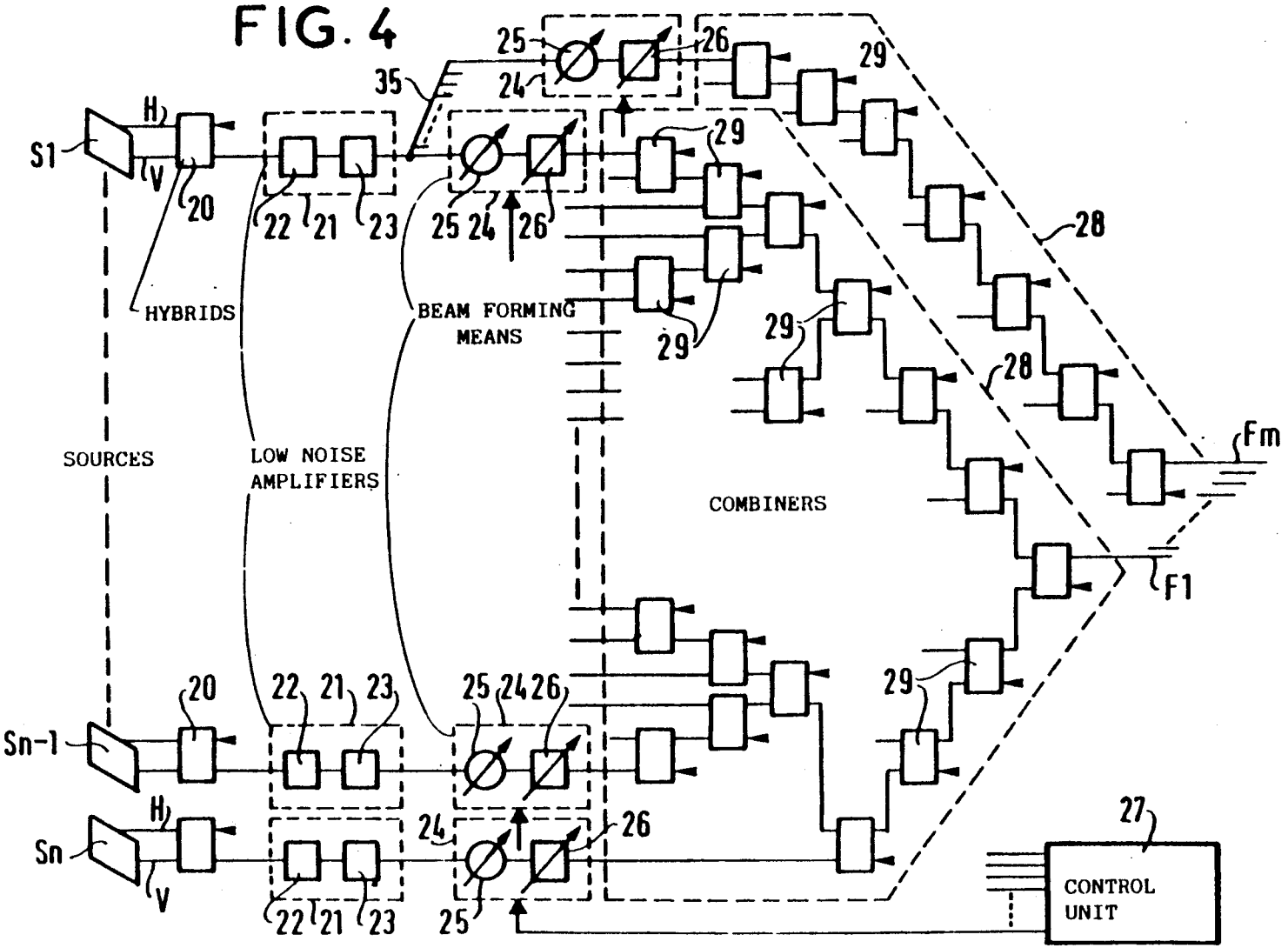
FIG. 4 shows a second embodiment of feed and control electronics for the antenna of the invention.

When m beams are received, the feed electronics is as shown in FIG. 4.

In this figure, items identical to those shown in FIG. 3 are given the same reference numerals.

A low noise amplifier circuit 21 is disposed behind each source Sj. After amplification, the signal is divided (35) by the number m of users without significant degradation of the ratio G/T (where G is gain and T is noise temperature).

The beam-forming circuits 24 then adjust the amplitude and phase of each of these signals, and the signals are then applied to m power combiners 28 with an output maximum being obtained after summing. m signals F1, . . . , Fm are then obtained corresponding to each of the beams.

In order to limit the number of channels that need to be summed, it may be observed that for a given direction $\theta$, only a portion of the array. contributes significantly to performance. Thus, by using a switching device, it is possible to make do with a summing circuit having few channels. In order to follow the path of a spot over the array at times t and t+1, the switching system operates as follows: the active circuits corresponding to q elementary sources Sp, Sp+1, Sp+q, in functional state N (time t) are subsequently attributed to q elementary sources Sr, Sr+1, Sr+q in following functional state N+1 (time t+1).

A moving target is then tracked as follows:

for small variations, the field matching components are updated (phase and amplitude for each channel) in order to keep the maximum level of directivity pointing towards the target; and when the displacement of the spot reaches a certain threshold, the paths are switched so as to keep active those elements which contribute most to the overall gain performance.

Thus, a switching device is disposed between the low noise amplifier circuit 21 and the feed and phase shifting circuit 24 in such a manner as to ensure that only those elements which receive significant power are monitored by an array of reduced size and a power combiner; with only a group of elements rather than the entire array being monitored for each beam (or each user).

Such a variant makes it possible to obtain a considerable saving in mass.

Figure 5:
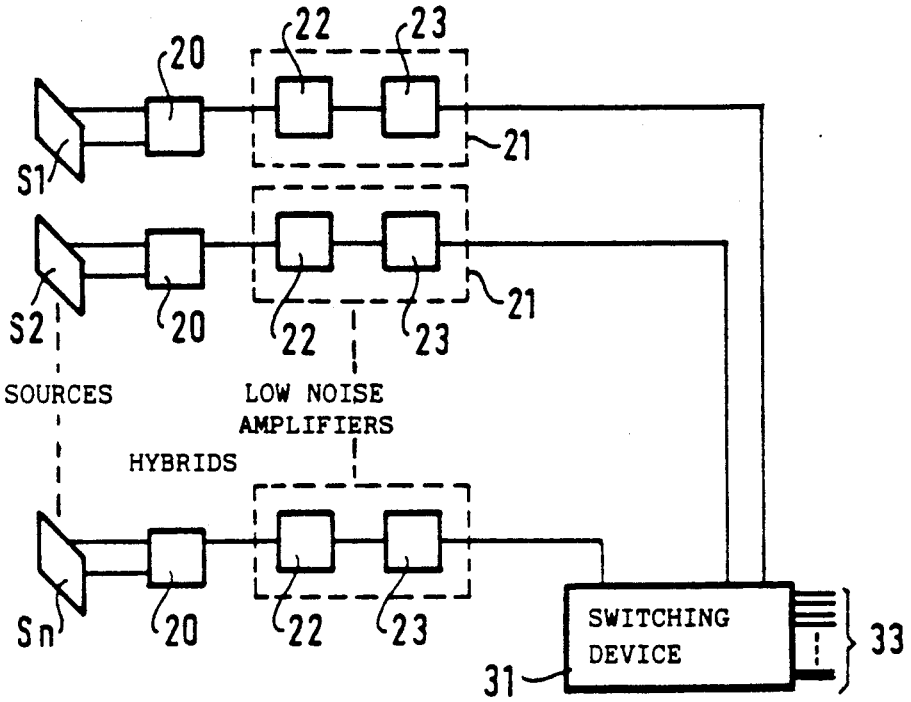
FIGS. 5, 6, and 7 show a third embodiment of feed electronics for the antenna of the invention.

As shown in FIG. 5, when using only one beam, the sources Sj followed by their respective hybrid couplers 20 and low noise amplifier circuits 21 are connected to a switching device 31.

Figure 7:
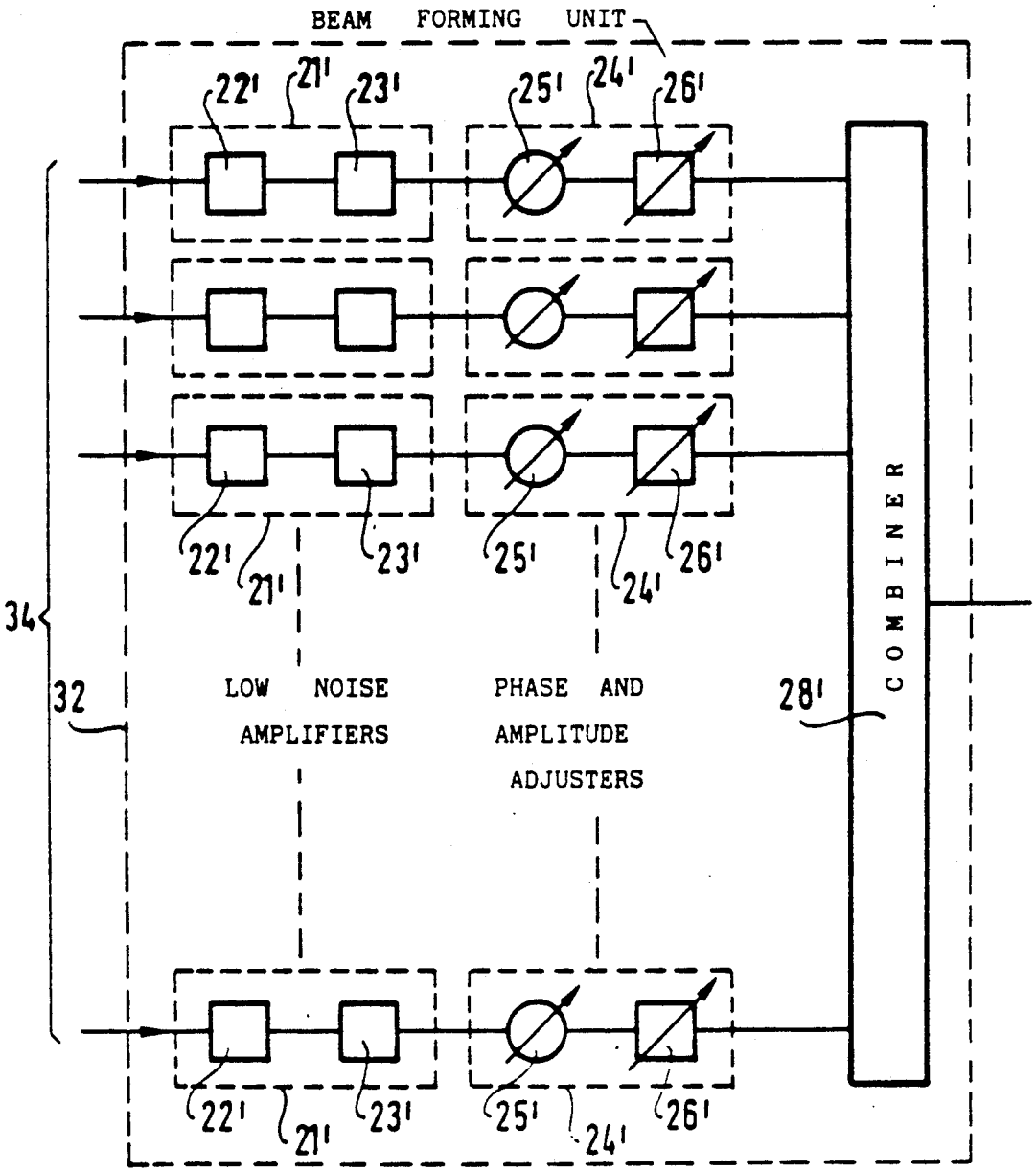
Figure 8:
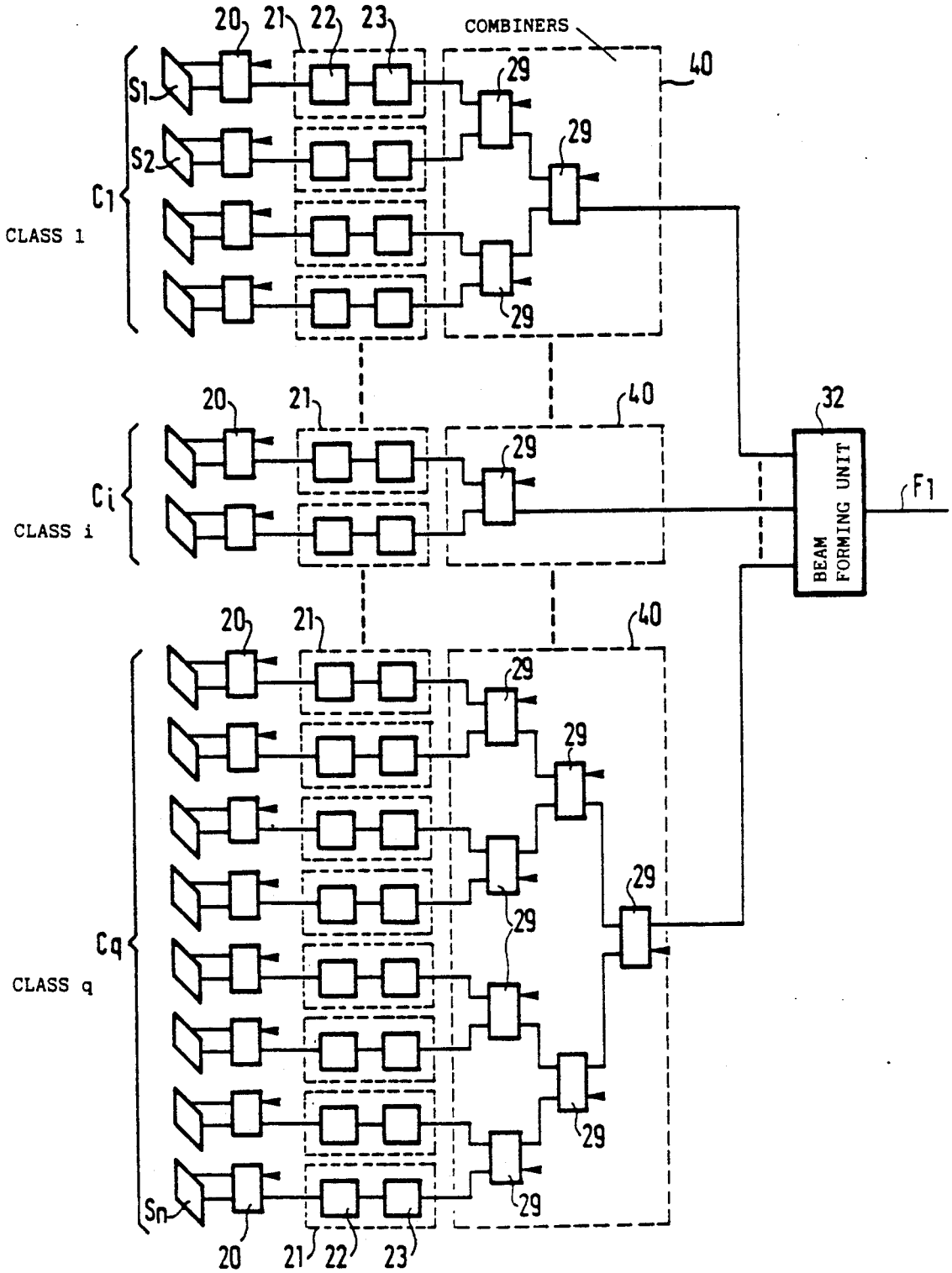
FIGS. 8, 9, and 10 show a fourth embodiment of a feed for an antenna of the invention.

The q outlets 33 from the switching device 31 constitute the inlets 34 to a beam forming unit 32 shown in FIG. 7, which corresponds to that shown in FIG. 3 except that it has fewer circuits. In order to distinguish its circuits from those shown in FIG. 3, their reference numerals include a prime symbol '.

Figure 6:
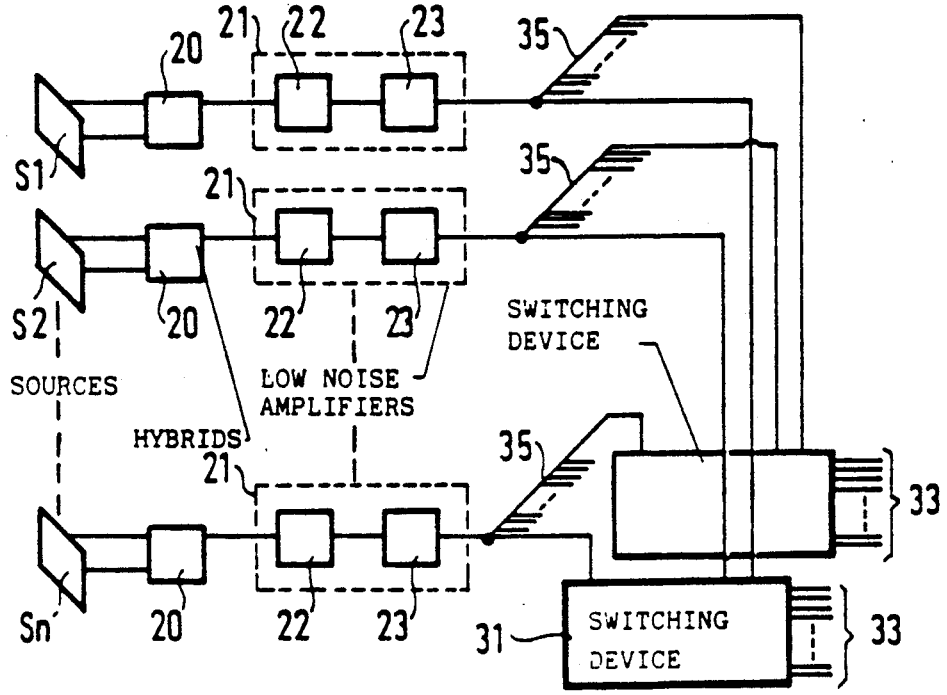

This third embodiment can equally well be adapted to m beams, in which case each beam has one switching device, as shown in FIG. 6. The outputs from these m switching devices are connected to m beam-forming units 32.

A fourth variant of the antenna of the invention makes it possible to considerably reduce the number of attenuation and phase-shifting circuits.

It consists in replacing the switching devices 31 by passive circuits, thereby reducing complexity and improving antenna reliability while retaining the advantages of the variant that uses switching circuits.

This variant is based on the following observation: of the n radiating elements constituting the antenna, some are never used simultaneously. They may be grouped together in classes Cl to Cq each containing 2 to X reception units (where a receiver unit comprises a radiating element 20+a filter 22+a low noise amplifier 23); such that each unit is used sequentially.

In each class, the reception units are grouped on a passive combiner 40 constituted by identical and balanced couplers 29. If q classes are used, there will therefore be q outlets connected to the q inlets of a beam-forming unit 32, thereby reducing the number of attenuation and phase shifting circuits 24 by a factor q/n.

For each class Ci, the radiating element used at any given instant is designated by powering the low noise amplifier 23 associated therewith. This disposition has the advantage of reducing the overall power consumption of the amplifiers by a factor q/n.

In the application mentioned below by way of example, the antenna comprises 128 radiating elements split up into 29 classes of 2 to 8 elements each, with only one element in each class being used at a time.

The number of phase shifting and attenuation units is reduced by a factor of more than 4, thereby improving overall mass and reliability.

The figures show an extension of the variant proposed for utilization of an antenna by m users, i.e. requiring m simultaneous beams F1 to Fm.

Figure 9:
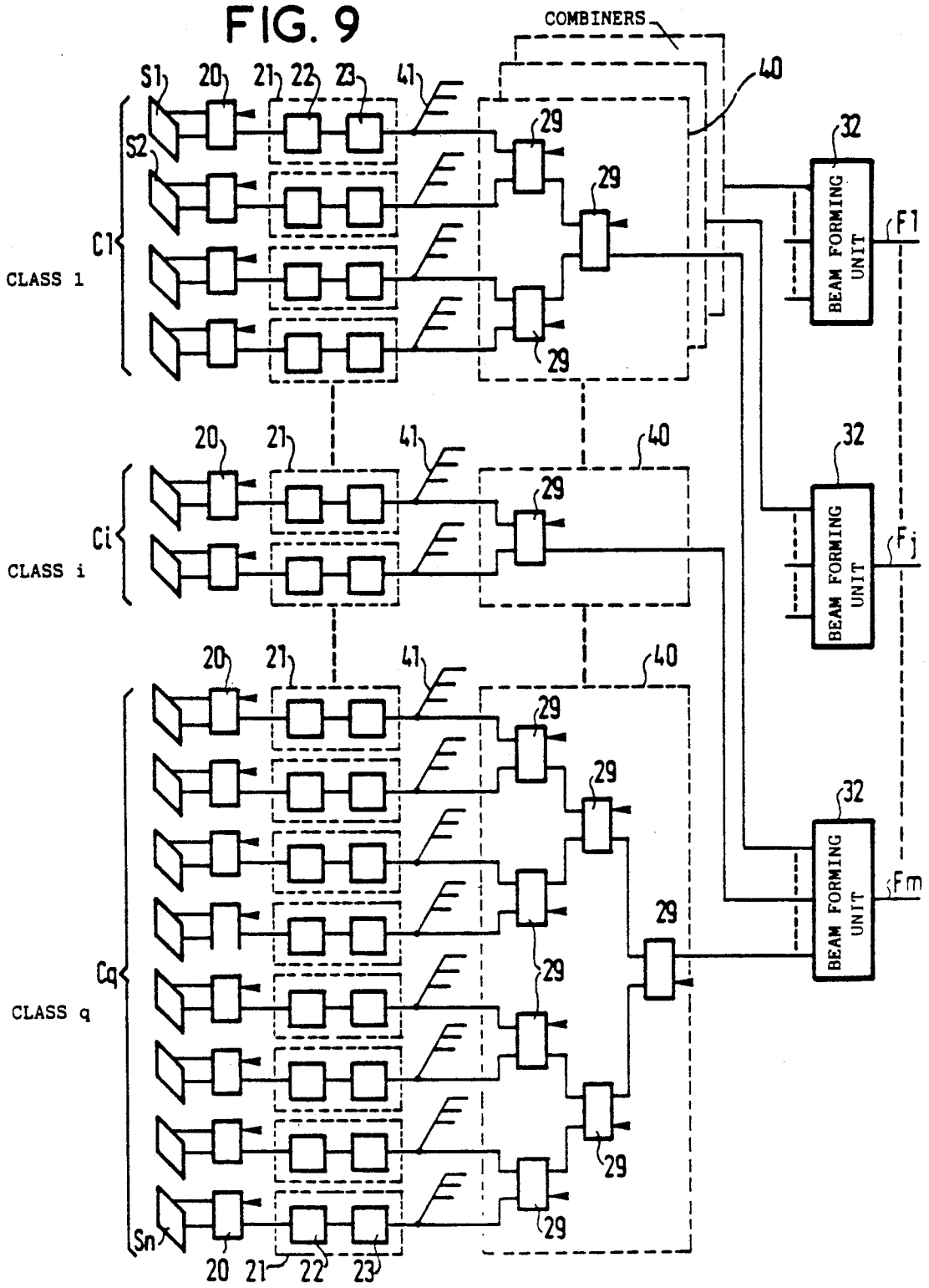

FIG. 9 shows a configuration in which the beam dividers 41 are situated before the combiners 40.

Figure 10:
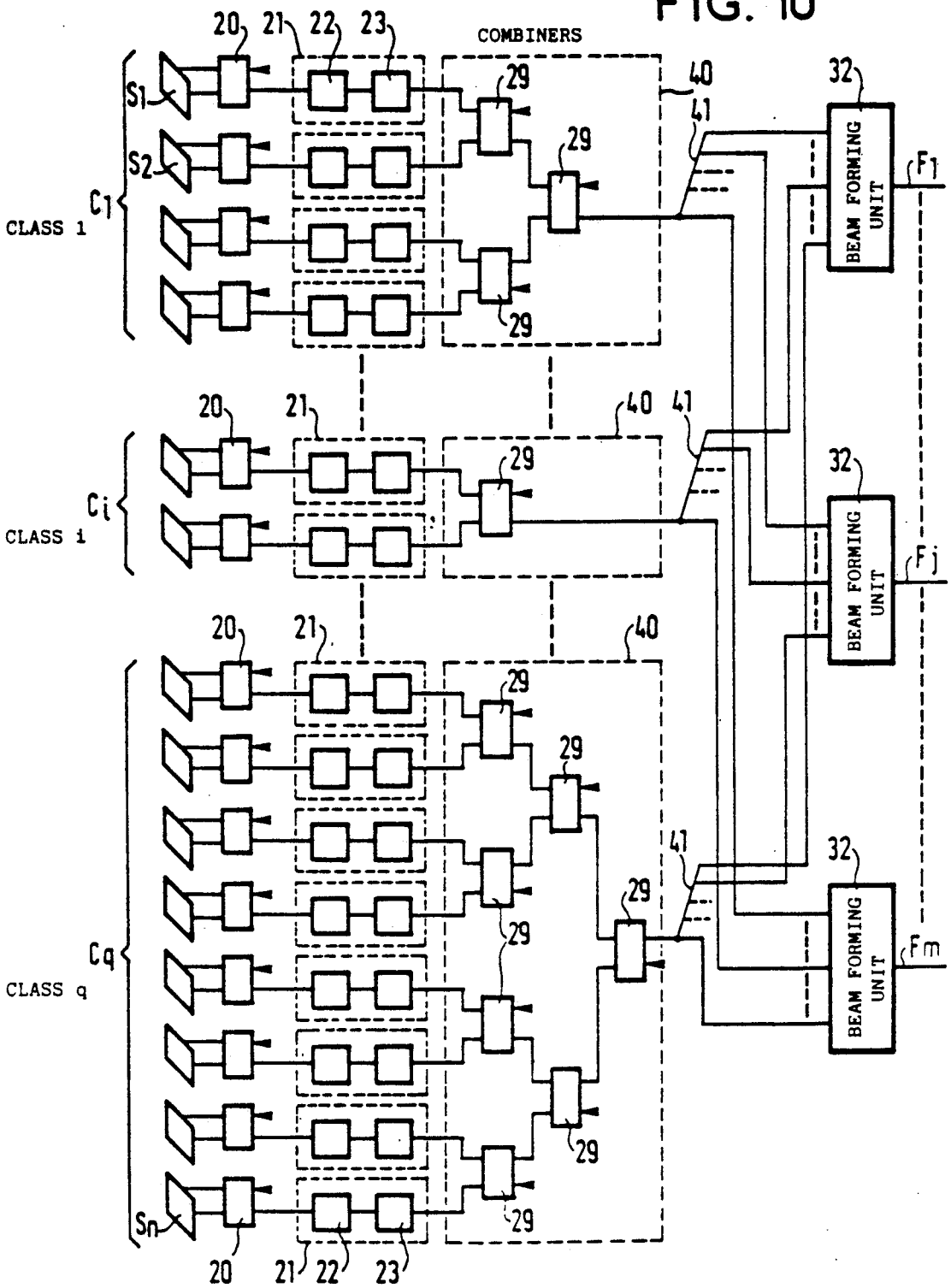

FIG. 10 shows a configuration in which the dividers 41 are situated after the combiners 40, thereby reducing their number by a factor q/n, but reducing the possibilities of combining reception units into utilization classes. An optimization study may lead to a configuration intermediate between these two configurations.

The operation of the electronically scanned antenna of the invention is described above for beam reception; however it is equally applicable to transmission: in transmission the filters 22 and the low noise amplifiers 23 shown in FIGS. 2, 3, 5, and 7 are replaced by corresponding power components.

The array 11 of elementary sources may be constituted, for example, by an array of elements printed on a support (known as a "patch") with each of the elements optionally being a multifrequency antenna, e.g. a two frequency antenna.

Naturally the present invention has been described and shown merely by way of preferred examples and its component elements could be replaced by equivalent elements without thereby going beyond the scope of the invention.

We claim:

1. An electronically scanned antenna comprising an array of elementary sources, an energy-focusing reflector, and feed and control electronics, with the array being situated in the focal zone of the reflector, wherein said feed and control electronics comprises:

a plurality of passive combiners each coupled to a respective group of said elementary sources in which only one elementary source can be active at any one time; and a divider between each elementary source and its respective combiner for dividing a signal from said each elementary source into a plurality of signals with each of said plurality of signals from each divider being coupled to a different combiner.

2. An electronically scanned antenna comprising an array of elementary sources, an energy-focusing reflector, and feed and control electronics, with the array being situated in the focal zone of the reflector, wherein said feed and control electronics comprises:

a plurality of passive combiners each coupled to a respective group of said elementary sources in which only one elementary source can be active at any one time;

beam forming means including a plurality of beam forming units for adjusting the phase and amplitude of signals received from said passive combiners; and a divider between each combiner and said beam forming means for dividing a signal from said each combiner into a plurality of signals, with each of said plurality of signals from each divider being coupled to a different beam forming unit.

3. An electronically scanned antenna comprising an array of elementary sources, an energy-focusing reflector, and feed and control electronics, with the array being situated in the focal zone of the reflector, wherein said feed and control electronics comprises a plurality of passive combiners each coupled to a respective group of said elementary sources in which only one elementary source can be active at any one time, each said combiner including successive sets of microwave couplers with each coupler receiving two inputs and providing one output, with the couplers in a first of said successive sets receiving inputs from respective elementary sources and the couplers in each succeeding set receiving inputs from the outputs of the couplers in a previous set, with a last set comprising a single coupler for providing a combiner output signal.

4. An electronically scanned antenna comprising an array of elementary sources, an energy-focusing reflector, and feed and control electronics, with the array being situated in the focal zone of the reflector, wherein said feed and control electronics comprises:

a plurality of passive combiners each coupled to a respective group of said elementary sources in which only one elementary source can be active at any one time; and control means between said elementary sources and said passive combiners for selectively activating at any one time only one of the input signals to each passive combiner, said control means selectively activating a low noise amplifier associated with each said elementary source.

* * * * *